US005509515A

United States Patent [19]

Guo

[11] Patent Number: 5,509,515

[45] Date of Patent: Apr. 23, 1996

[54] COMBINATION HANDBAG

[76] Inventor: I-Hong Guo, No. 19, Alley 18, Lane 130, Sec3, Min-Sheng E. Rd., Taipei, Taiwan

[21] Appl. No.: 421,844

[22] Filed: Apr. 13, 1995

[51] Int. Cl.[6] ..... A45C 5/06; A45C 13/28

[52] U.S. Cl. ..... 190/110; 190/108; 150/111; 150/113

[58] Field of Search ..... 190/102, 110, 190/107, 111, 115; 150/111, 113; 383/37

[56] References Cited

U.S. PATENT DOCUMENTS

| | | | |
|---|---|---|---|
| Re. 25,826 | 8/1965 | Ward | 190/108 |
| 2,536,169 | 1/1951 | Gray | 190/110 X |
| 3,061,057 | 10/1962 | Miller | 190/110 |
| 3,830,348 | 8/1974 | Ohyama | 190/108 X |
| 4,081,061 | 3/1978 | Tucker | 190/108 |
| 4,436,189 | 3/1984 | Baum | 190/108 |
| 4,756,394 | 7/1988 | Cohen | 190/110 X |
| 4,781,278 | 11/1988 | Sadow | 190/107 |
| 4,953,674 | 9/1990 | Landes | 190/108 |
| 5,186,290 | 2/1993 | Takayama | 190/110 X |

FOREIGN PATENT DOCUMENTS

| | | | |
|---|---|---|---|
| 792383 | 12/1935 | France | 190/107 |

*Primary Examiner*—Sue A. Weaver
*Attorney, Agent, or Firm*—Bacon & Thomas

[57] ABSTRACT

A combination handbag including a rear bag unit and a front bag unit joined by a slide fastener, two top handles respectively and fixedly secured to the rear bag unit and the front bag unit at two opposite sides, the front bag unit having two zipper tapes respectively arranged at an outer side into a respective four-sided figure for mounting a respective small bag, which has a matching zipper tape, the rear bag unit having a zipper tape at an outer side along the border for mounting an outside compartment flap or a second combination handbag which has a matching zipper tape.

5 Claims, 5 Drawing Sheets

COMBINATION HANDBAG

BACKGROUND OF THE INVENTION

The present invention relates to handbags, and relates more particularly to a combination handbag which can be arranged into different combinations for different purposes.

A variety of bags have been disclosed for different purposes, and have appeared on the market. These bags are commonly not extendible, therefore they cannot be adjusted or changed subject to the volume of the load.

SUMMARY OF THE INVENTION

The present invention provides a combination handbag which can be adjusted according to the volume and/or type of the things to be carried. According to the present invention, the combination handbag comprises a base handbag formed of a rear bag unit and a front bag unit joined by a slide fastener, two top handles respectively and fixedly secured to the rear bag unit and the front bag unit at two opposite sides, wherein the front bag unit comprises two zipper tapes respectively arranged at an outer side into a respective four-sided figure for mounting a respective small bag; the rear bag unit comprises a zipper tape at an outer side along the border for mounting an outside compartment flap or a second combination handbag.

BRIEF DESCRIPTION OF TEE DRAWINGS

DETAILED DESCRIPTION OF TEE PREFERRED EMBODIMENT

Figure 1:
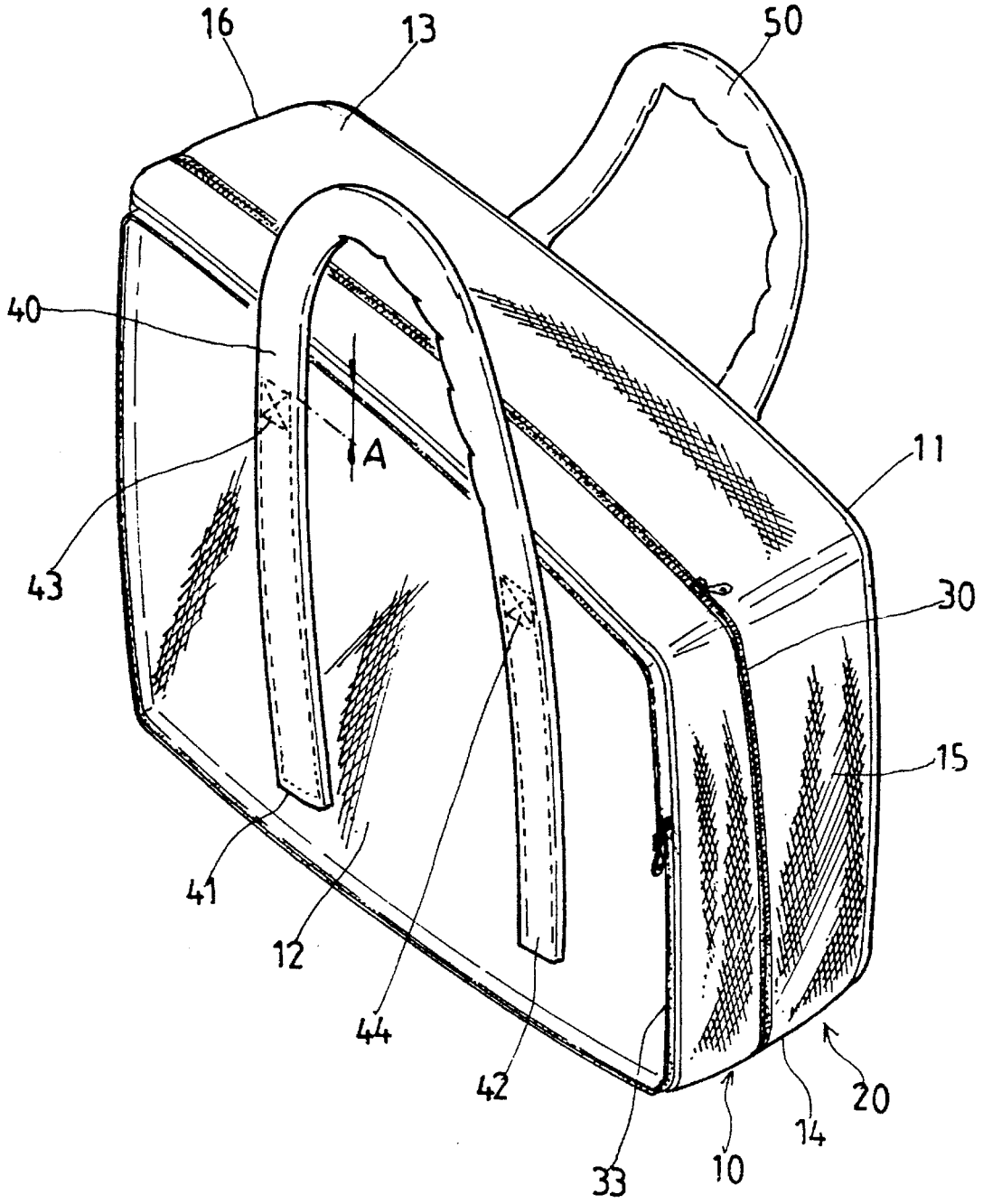
FIG. 1 is an elevational view of a base handbag according to the present invention.

Referring to FIG. 1, a handbag is shown formed of a rear bag unit 10 and a front bag unit 20 joined by a slide fastener 30. The handbag comprises a front panel 11, a back panel 12, a top panel 13, a bottom panel 14, two opposite side panels 15 and 16, and two top handles 40 and 50 respectively fastened to the front panel 11 and the back panel 12. The top handles 40 and 50 each has two opposite ends 41 and 42 fastened to the front panel 11 and the back panel 12 by stitches. The fixed portions 43 and 44 between the top handle 40 or 50 and the front panel 11 or back panel 12 are equally spaced from the top panel 13 by a distance A.

Figure 2:
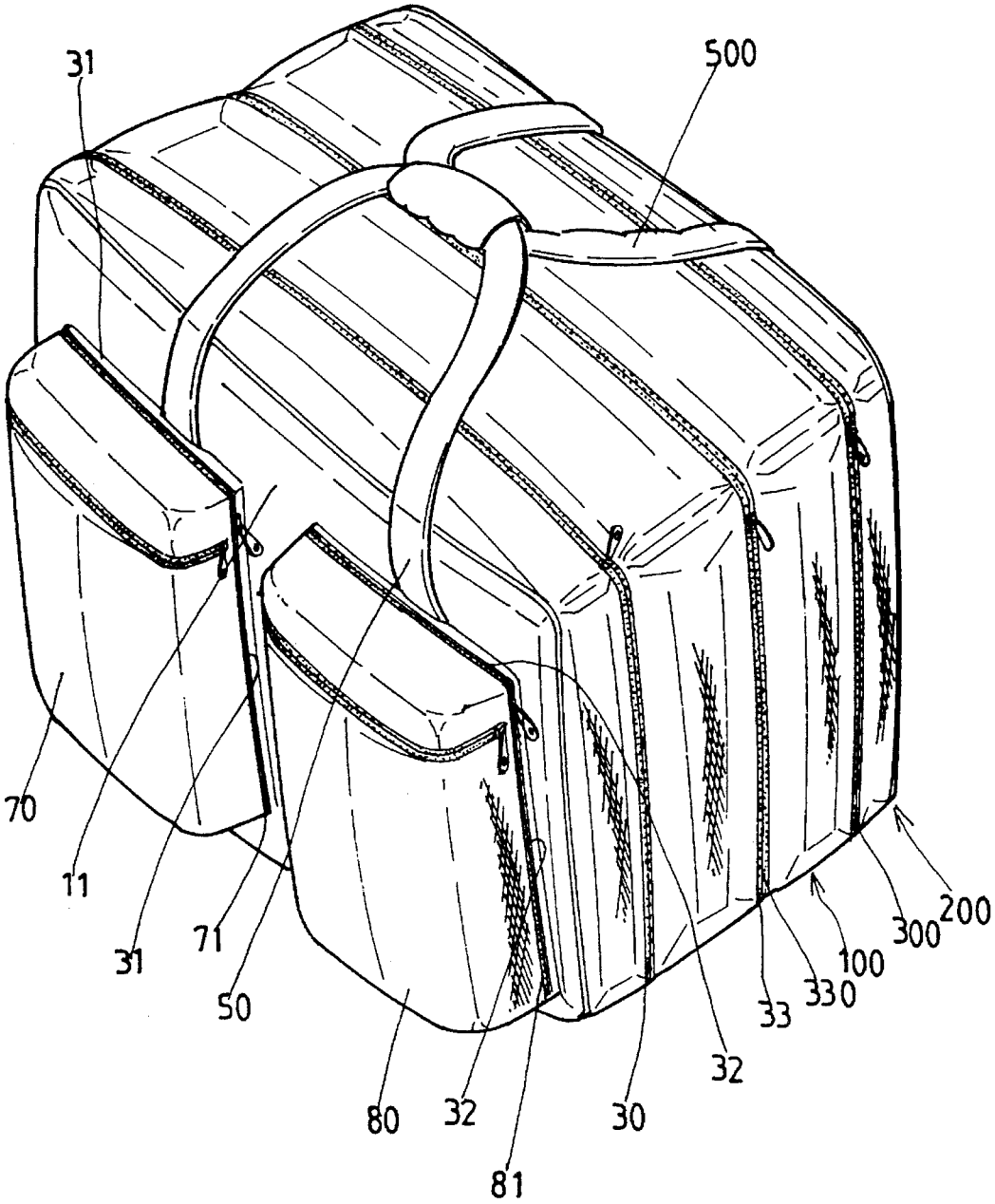
FIG. 2 shows two base handbags joined together and two small bags fastened to one base handbag according to the present invention.

Referring to FIG. 2 two zipper tapes 31 and 32 are respectively mounted on the front panel 11 and arranged into a respective four-sided figure, and a zipper tape 33 is mounted on the back panel 12 along the border, as seen in FIG. 1. A second handbag which is formed of a rear bag unit 100 and a front bag unit 200 joined by a slide fastener 300 can be fastened to the aforesaid first handbag by fastening up a zipper tape 330 of a back panel (not shown) of the second handbag with the zipper tape 33 of the back panel 12 of the first handbag. When the two handbags are joined together, the top handle 40 on the back panel 12 of the first handbag and a top handle (not shown) on the back panel of the second handbag are turned inwards and received within the space defined between the two handbags within the zipper tapes 33 and 330, and the top handle 50 on the front panel 11 of the first handbag and a top handle 500 on the front panel (now shown) of the second handbag are exposed to the outside for carrying by hand.

Figure 3:
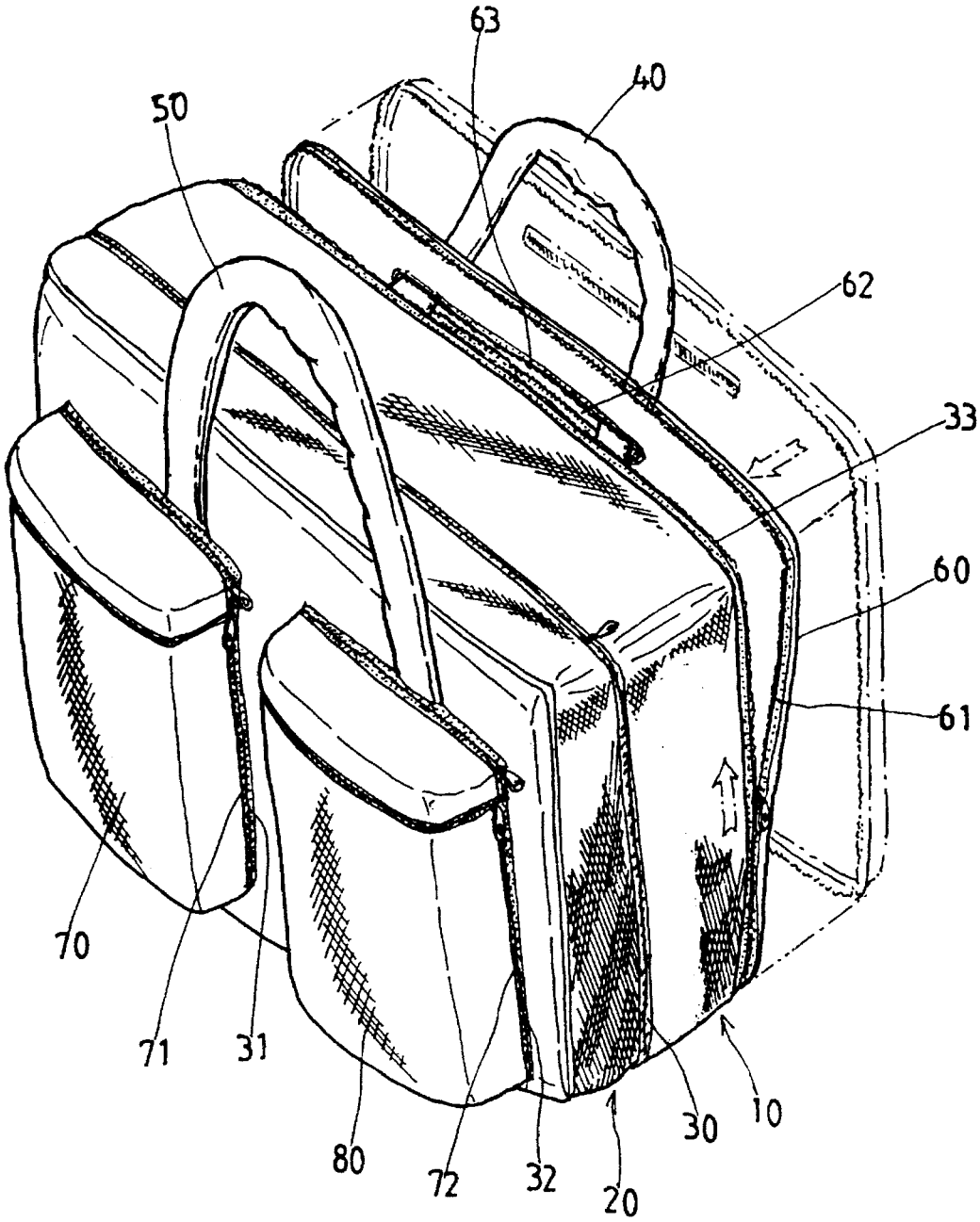
FIG. 3 shows two small bags and an outside compartment flap respectively fastened to the front and back panels of the base handbag shown in FIG. 1.

Referring to FIG. 3, an outside compartment flap 60 is provided having a zipper tape 61 along the border for fastening the zipper tape 33 on the back panel 12 of the handbag shown in FIG. 1, an elongated slot 62 through which the top handle 40 of the back panel 12 can be extended outside the outside compartment flap 60, and a slide fastener 63 mounted around the elongated slot 62 and controlled to close/open the elongated slot 62.

Figure 4:
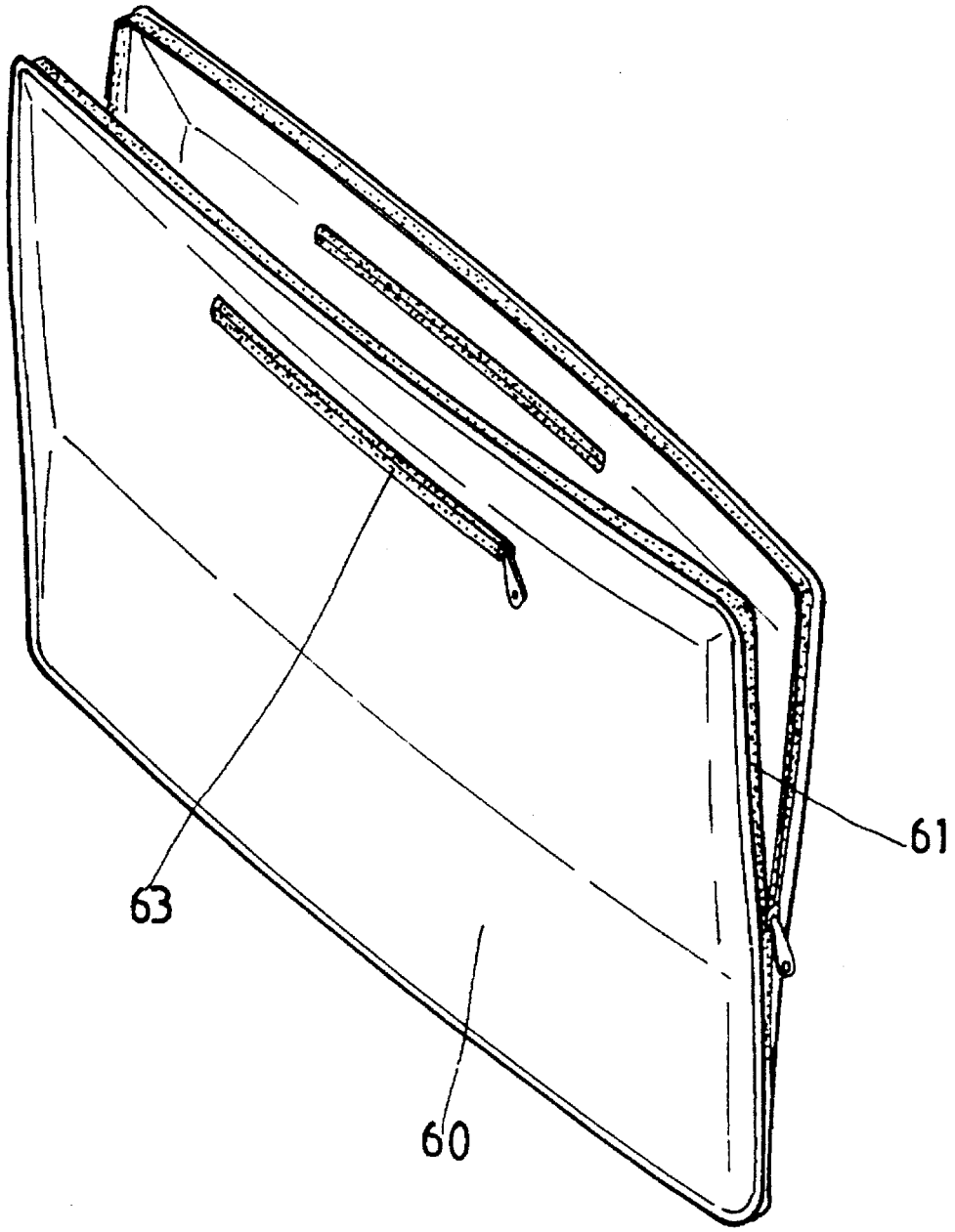
FIG. 4 shows two outside compartment flaps joined together and formed into a portfolio according to the present invention.

Referring to FIG. 4, two outside compartment flaps 60 can be arranged into a portfolio by fastening the respective zipper tapes 61 together.

Figure 5:
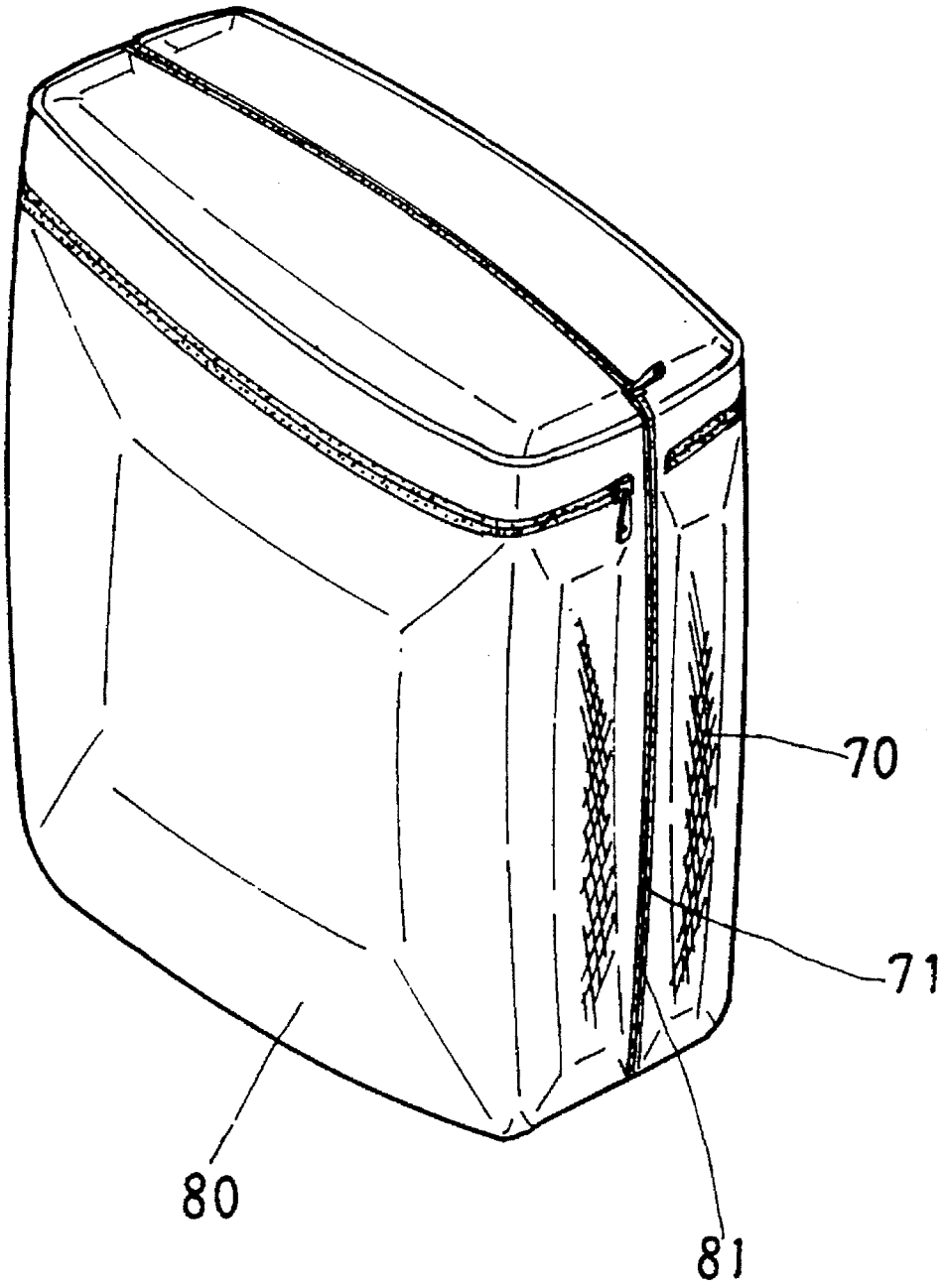
FIG. 5 shows two small bags joined together according to the present invention.

Referring to FIGS. 2 and 3 again, two small bags 70 and 80 are provided having a respective zipper tape 71 or 81 at the back side along the border for fastening to the zipper tape 31 or 32 on the front panel 11 of the handbag shown in FIG. 1. When the small bags 70 and 80 are detached from the handbag shown in FIG. 1, they can be separately used as a respective individual handbag, or joined together by fastening up the respective zipper tapes 71 and 81 (see FIG. 5).

As indicated, the rear bag unit 10, the front bag unit 20, the outside compartment flap 60, and the small bags 70 and 80 can be alternatively arranged into any of a variety of forms as desired.

It is to be understood that the drawings are designed for purposes of illustration only, and are not intended as a definition of the limits and scope of the invention disclosed.

The invention claimed is:

1. A combination handbag comprising:

a) a first bag assembly including a rear bag unit and a front bag unit, and a slide fastener for detachably securing the rear and front bag units together;

b) the rear bag unit including a back panel provided with a zipper tape extending around a border thereof and a top handle;

c) the front bag unit including a front panel provided with a top handle; and d) a compartment flap including a zipper tape around a border thereof for detachably securing the compartment flap to the zipper tape of the back panel, an elongated slot formed in the compartment flap for receiving the top handle on the back panel therethrough when the compartment flap is secured to the back panel, and a slide fastener mounted to the elongate slot for opening and closing the slot.

2. The combination handbag of claim 1 wherein the front panel further includes a pair of rectangular-shaped zipper tapes, a pair of bags, each bag having a zipper tape along a border thereof for detachably fastening the bag to a zipper tape on the front panel.

3. The combination handbag of claim 2 wherein the zipper tapes of the bags are detachably securable to each other.

4. The combination handbag of claim 1 further including a second compartment flap including a zipper tape around a border thereof for detachably securing the second compartment flap to the zipper tape of the first compartment flap.

5. The combination handbag of claim 1 further including:

a) a second bag assembly including a rear bag unit and a front bag unit, and a slide fastener for detachably securing the rear and front bag units together;

b) the rear bag unit including a back panel provided with a zipper tape extending around a border thereof for detachably securing the second bag assembly to the zipper tape on the back panel of the first bag assembly, the rear bag unit further including a top handle; and c) the front bag unit including a front panel provided with a top handle.

* * * * *